United States Patent [19]

Johnston

[11] Patent Number: 4,486,025

[45] Date of Patent: Dec. 4, 1984

[54] STRIPPER PACKER

[75] Inventor: Vaughn R. Johnston, Washington, Pa.

[73] Assignee: Washington Rotating Control Heads, Inc., Washington, Pa.

[21] Appl. No.: 586,318

[22] Filed: Mar. 5, 1984

[51] Int. Cl.[3] ..... F16J 15/56

[52] U.S. Cl. ..... 277/31; 175/195

[58] Field of Search ..... 277/1, 2, 31; 175/195, 175/214

[56] References Cited

U.S. PATENT DOCUMENTS

| | | | |
|---|---|---|---|
| 2,170,916 | 8/1939 | Schweitzer et al. | 255/1 |
| 3,400,938 | 9/1968 | Williams | 277/31 |
| 3,503,617 | 3/1970 | Williams | 277/9 |
| 4,154,448 | 10/1977 | Biffle | 277/2 |
| 4,208,056 | 6/1980 | Biffle | 277/2 |
| 4,312,404 | 1/1982 | Morrow | 277/31 |
| 4,345,769 | 8/1982 | Johnston | 277/31 |
| 4,363,357 | 12/1982 | Hunter | 277/31 |
| 4,367,795 | 1/1983 | Biffle | 277/31 |

*Primary Examiner*—Robert I. Smith

*Attorney, Agent, or Firm*—Carothers & Carothers

[57] ABSTRACT

A stripper packer having a mounting collar to which a stripper rubber is releasably secured by compressive clamping means in a manner such that the compressively deformed stripper rubber is maintained in releasable fluid pressure-tight face sealing engagement with the mounting collar.

8 Claims, 2 Drawing Figures

STRIPPER PACKER

Figure 1:
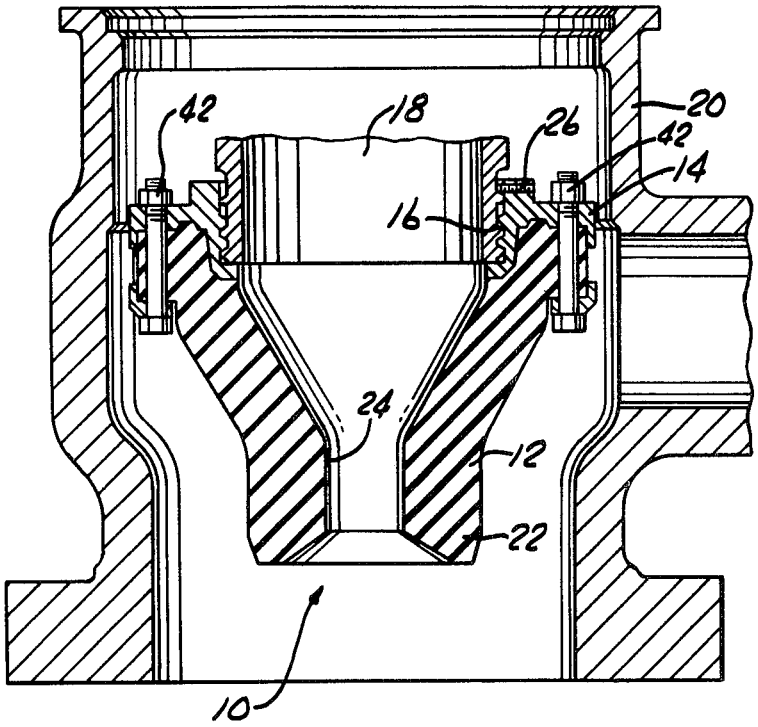

Oil and gas wells are drilled with a drill bit attached to a hollow drill string which passes down through a well casing installed in the well bore. A drilling head is usually attached to the top of the well casing where it emerges from the ground to seal the interior of the well casing from the surface and thereby permit the forced circulation of drilling fluid or gas during drilling operations. In the more commonly-used forward circulation drilling mode, the drilling fluid or gas is pumped down through the interior of the hollow drill string, out the bottom thereof, and upward through the annulus between the exterior of the drill string and the interior of the well casing. In reverse circulation, the drilling fluid or gas is pumped down the annulus between the drill string and the well casing and then upward through the hollow drill string.

Prior art drilling heads often have included a stationary body which carries a rotatable spindle that is rotated by a kelly driving the rotary drilling operation. A seal or packing, often referred to as a stripper packer, is carried by the spindle to seal the periphery of the kelly or the sections of drill pipe, whichever is passing through the spindle, and thereby confine the fluid pressure in the well casing and prevent the drilling fluid, whether liquid or gas, from escaping between the rotary spindle and the drill string.

Numerous stripper packers have been developed to provide rotational and slideable sealing of the drill string within the drilling head. The rotation of the kelly and drill string, the frequent upward and downward movement of the kelly and drill string during addition of drill pipe sections, and the high pressures to which the drilling head is subjected, demand that the packing components in the drilling head be able to withstand continuous use without incurring excessive wear. As modern oil and gas wells go to greater depths, and the popularity of air drilling increases, even more reliable means of sealing the drill string against release of internal drilling fluid pressure are being sought.

In particular, the attachment of the stripper packer to the lower end of the rotary spindle has been one source of problems in the containment of drilling fluid pressure. Typically, the stripper packer includes an elongated generally cylindrical hard-rubber packer having an annular mounting collar secured to its upper end. The mounting collar, in turn, is secured onto the lower end of the rotatable spindle. Often the mounting collar is secured to the stripper packer by being molded integrally therewith. That is, the mounting collar often includes such structural expedients as a radially-projecting lip, a circumferential dovetail keyway, or a plurality of radial through openings onto or through which the stripper rubber is directly molded for a positive mechanical interlock between the mounting flange and the stripper rubber. Some such packers may have been subject to instances of tearing of the stripper rubber or breaking of the fluid seal with the mounting collar due to localized stress concentrations at the rubber to collar interface. Increased cost of manufacture has resulted from the complexities of the molding process and the complex design of the mounting collar. Likewise, increased final product cost has resulted from the need of supplying a new, integrally-molded mounting collar with each replacement stripper rubber even though the mounting collar itself often is not worn or otherwise in need of replacement. Among the known structures are those disclosed in U.S. Pat. Nos. 4,345,769; 3,503,617; 3,400,938; and 2,170,916.

The art has not produced many viable alternatives to the above-described structures due, in part, to the difficulty of forming suitable releasable connection between a mounting collar and a stripper rubber. This has been particularly true in those cases where the frictional engagement between the stripper rubber and the drill string provides the rotary driving force for the rotary spindle in the drilling head. In such instances, the stripper rubber is under constant torque loading and this tends to accelerate wear and ultimate failure of the rubber-to-mounting collar seal.

The present invention provides an improved stripper rubber which is selectively detachable from the mounting collar. When assembled, the stripper rubber is clamped to the mounting collar by a compression ring fitting which maintains the stripper rubber in compressive engagement with the mounting collar to provide a fluid-tight and pressure-tight face seal therebetween and to support rotary torque loads transmitted via the stripper rubber from the rotating drill string to the rotary spindle.

It is therefore, one general object of the invention to provide a novel stripper rubber assembly having a rubber packer which is releasably secured to a mounting collar.

A more specific object of the invention is to provide a stripper rubber assembly including a releasable compression assembly which secures the rubber to the mounting collar.

Another object of the invention is to provide such a stripper rubber assembly which will maintain a selectively releasable seal between the rubber and the mounting collar under the torque loads imposed upon a stripper rubber which is utilized to transmit drill string rotation to the rotary spindle upon which the mounting collar is mounted.

Still another object of the invention is to provide a packer having a selectively releasable, unreinforced stripper rubber.

Other objects and advantages appear in the following description and claims.

Figure 2:
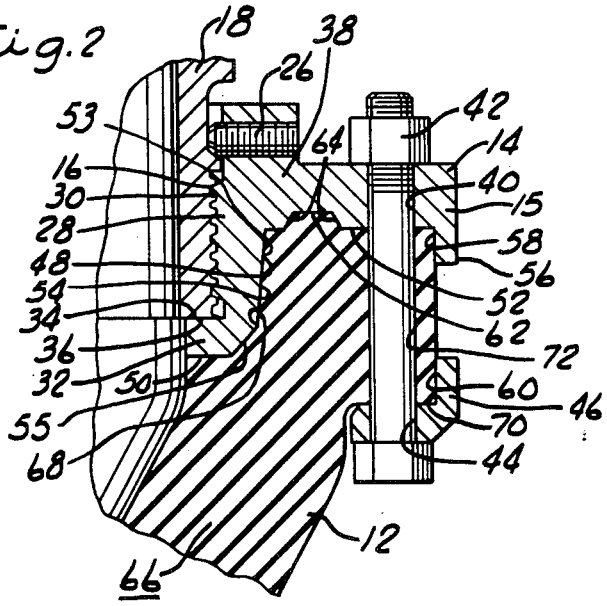

The accompanying drawings show, for the purpose of exemplification without limiting the invention or the claims thereto, certain practical embodiments illustrating the principles of this invention wherein:

FIG. 1 is a fragmentary, elevational section of a drilling head including a stripper packer of the present invention; and FIG. 2 is an enlarged fragmentary portion of FIG. 1.

There is generally indicated at 10 in FIG. 1 a stripper packer comprising a generally cylindrical stripper rubber 12 which is releasably secured to a mounting collar assembly 14. Collar 14 is in turn, mounted by threaded engagement as at 16 on the lower end of a rotary spindle 18 that is rotatably carried by bearings (not shown) of a drilling head 20.

The stripper rubber 12 converges downwardly to an internal diameter smaller than the outer diameter of the drill pipe (not shown) which is to be passed therethrough. Accordingly, the drill pipe, when inserted therein, expands the lower end 22 of the stripper rubber radially to create a fluid pressure tight circumferential seal between the drill pipe and the internal surface 24 of stripper rubber lower end 22. A radially-disposed setscrew 26 is threadedly engaged within collar 14 to secure the threaded engagement thereof on rotary spindle 18.

Because the above-described elements of drilling head 20 are well known to those skilled in the art, further detailed description thereof is considered to be unnecessary for an understanding of the present invention.

Referring to FIG. 2, the mounting collar assembly 14 includes a generally annular formed collar structure 15 of machined steel or the like having a generally vertically-extending portion 28 with an interior periphery 30 on which threads 16 are formed. A radially-inwardly projecting lower flange portion 32 includes an upwardly-facing seal surface 34 which engages a mating, downwardly-facing seal surface 36 formed on the lower end of rotary spindle 18 for face-sealing engagement therewith. An upper flange portion 38 extends radially outward of the upper end of vertical portion 28 and includes a plurality of axially-extending, circumferentially-spaced through bores 40, twelve bores for example, which receive nut and bolt assemblies 42.

An entire similar plurality of axial through bores 44 is provided within a clamping annulus 46 at a radius and a circumferential spacing to permit alignment with respective bores 40 such that each bolt assembly 42 may be passed through an aligned pair of bores 40, 44.

The lower surface of mounting collar 15 provides a formed sealing surface 48 against which the stripper rubber 12 is sealingly compressed by annulus 46. Surface 48 includes a downwardly-facing surface portion 50 adjacent a radially-inner part of flange portion 32, a downwardly-facing formed upper surface portion 52 located above and radially outwardly from surface portion 50, and a generally vertically-extending inclined surface portion 54 connecting the surface portions 50 and 52. Surface portion 54 preferably includes a portion 53 which is disposed at a relatively lesser angle with respect to vertical and an adjacent portion 55 which is disposed at a relatively greater angle to vertical.

A vertically-extending ring portion 56 depends from the radially-outermost portion of flange portion 38 and includes a radially-inwardly facing, annular surface 58 which serves to confine the upper end of stripper rubber 12 radially with respect to surface 48. A similar radially-inwardly facing annular surface portion 60 on compression annulus 46 also serves to confine the stripper assembly 12 with respect to surface 48. The surface portion 52 includes an upwardly-extending annular recess 62 having converging side walls 64 for confinement of the stripper rubber 12 as described hereinbelow.

The stripper rubber 12 includes a molded, unreinforced upper annular end portion 66 having a formed surface 68 which closely conforms to surface 48 and an opposed, annular surface portion 70 which receives clamping annulus 46. A plurality of aligned axial through openings 72 register with respective pairs of bores 40, 44 to receive bolt assemblies 42 therein.

It will be noted that in the deformation of resiliently deformable members, and especially those having no internal reinforcement, the applied forces will tend to deform the resilient member to a degree that sealing qualities, structural force transmission capability, and other desirable qualities may be seriously degraded. Thus, prior stripper rubbers have often been provided with rigid reinforcement structures molded therein to alleviate such adverse resilient deformation problems. Absent such rigid reinforcement, a conventional stripper rubber would, when compressively clamped as shown in FIG. 2, tend to roll radially inward as the rubber is deformed in compression between the clamping elements and thus forced radially inward and away from the zone of compression.

The present invention provides for a stripper rubber-to-mounting collar interface which alleviates such problems and provides, instead, a mode of rubber-to-collar face sealing and torque transmission which is enhanced by the compressive retention of the rubber as described. Specifically, the compression of the upper end 66 of stripper rubber 12 by bolt assemblies 42 between flange portion 38 and clamping annulus 46 tends to confine the upper end portion 66 between ring portions 46 and 56. A major part of the rubber material is located radially inward of the bolts 42 and is confined against the various portions of surface 48 whereby the rubber material is not free to roll radially inward on itself and thereby break the sealing engagement with surface 48. The compressive forces applied by bolts 42 thus tend to enhance the face sealing engagement of rubber surface 68 with surface 48. The annular recess 62 is believed to be particularly helpful in confining the stripper rubber and maintaining the engagement sealing surface thereof in undeformed, tight-sealing engagement with surface 48.

According to the description hereinabove there is provided by the instant invention an improved stripper packer assembly having separable mounting collar and stripper rubber elements wherein a compression clamp secures an unreinforced stripper rubber in face sealing engagement with an extended formed sealing surface of the mounting collar to provide a fluid pressure-tight seal therebetween and to provide for transmission of torque loads from the stripper rubber to the mounting collar.

These and other embodiments and modifications having been envisioned and anticipated by the inventor, the invention is to be construed as broadly as permitted by the scope of the claims appended hereto.

I claim:

1. A stripper packer adapted to be secured to the rotary spindle of a drilling head comprising:

an annular collar adapted to be secured to such a rotary spindle;

a stripper rubber carried adjacent its upper end by said collar and extending downwardly therefrom; said collar including a sealing surface having mutually-coaxial, vertically, spaced-apart, radially inner and outer annular seal surface portions and a vertically-inclined, radially-outwardly facing annular seal surface portion connecting said radially-inner and radially-outer surface portions;

the vertically higher of said radially inner and outer surface portions including an annular recess formed coaxially therewith;

a clamping annulus cooperable with said collar for compressively clamping said stripper rubber thereto;

said stripper rubber including a mating surface which conforms closely with said sealing surface; and selectively releasable compression clamping means located radially outward of said annular recess and cooperable with said collar and said clamping annulus to compressively clamp said rubber to said collar in a manner that said mating surface is maintained in substantially continuous, releasable face sealing engagement with the said sealing surface when said stripper rubber is deformed by the compressive clamping thereof.

2. The stripper packer as claimed in claim 1 wherein said radially-inner surface portion is located vertically below said radially-outer surface portion.

3. The stripper packer as claimed in claim 2 wherein said compressive clamping means includes a plurality of bolts spaced circumferentially about said mounting collar.

4. The stripper packer as claimed in claim 3 wherein a portion of said stripper rubber encompasses each of said bolts.

5. The stripper packer as claimed in claim 4 wherein said annular recess includes side walls which converge toward the bottom of said recess.

6. The stripper packer as claimed in claim 5 wherein said vertically-inclined surface portion diverges radially outward and upward from said radially-inner surface portion.

7. The stripper packer as claimed in claim 5 wherein said vertically-inclined surface portion includes a lower portion which is inclined to vertical at a given angle and an upper portion which is inclined to vertical at an angle smaller than said given angle.

8. The stripper packer as claimed in claim 7 wherein said upper end of said stripper rubber is unreinforced.

* * * * *